US005934994A

United States Patent [19]

Wylie et al.

[11] Patent Number: 5,934,994

[45] Date of Patent: Aug. 10, 1999

[54] DAMPER APPARATUS INCLUDING PLENUM AND MULTIPLE DAMPER BLADES

[75] Inventors: Calvin Richard Wylie, Fair Oaks; Eugene Scott Sahota, Newcastle, both of Calif.

[73] Assignee: Beutler Heating & Air Conditioning, Sacramento, Calif.

[21] Appl. No.: 08/816,210

[22] Filed: Mar. 12, 1997

[51] Int. Cl.[6] ..... F24F 3/00

[52] U.S. Cl. ..... 454/333; 137/883; 251/129.11; 251/878

[58] Field of Search ..... 137/883, 875; 251/129.11, 878; 454/333, 335

[56] References Cited

U.S. PATENT DOCUMENTS 2,295,145 9/1942 Welch ..... 137/875 X
3,389,858 6/1968 Capps ..... 137/875 X
3,965,933 6/1976 Beaudin ..... 137/875
5,096,156 3/1992 Wylie et al. .

FOREIGN PATENT DOCUMENTS 5-66046 3/1993 Japan ..... 454/333

*Primary Examiner*—Harold Joyce
*Attorney, Agent, or Firm*—Thomas R. Lampe

[57] ABSTRACT

Damper apparatus includes a housing and dividers in the interior of the housing. One of the dividers forms a plenum and two openings leading from the plenum to an air flow outlet of the housing. Separate damper blades control air flow through the openings. A second divider divides the housing interior into separate passageways, one passageway in communication with one opening and the other passageway in communication with the other opening.

9 Claims, 4 Drawing Sheets

DAMPER APPARATUS INCLUDING PLENUM AND MULTIPLE DAMPER BLADES

TECHNICAL FIELD

This invention relates to damper apparatus to be incorporated in a heating, cooling or ventilation system. More particularly, the apparatus includes a plenum with a plurality of motor driven damper blades located within a single housing to control the flow of air to different zones in a house or other building.

BACKGROUND OF THE INVENTION

In heating, cooling or ventilation systems it is well known to attach a housing defining a plenum directly to the furnace or other source of flowing air to be distributed within a building. Typically, several ducts are connected to the plenum housing to receive air from the plenum for subsequent distribution to the desired locations. Control dampers in the form of movable blades are often mounted in the ducts themselves to control air flow through the ducts.

Such prior art arrangements can occupy a considerable amount of space. Furthermore, extensive duct work may be required. Fabrication and installation of such systems can be time consuming and expensive.

It is well known to provide motor driven damper blades in the ducts of prior art systems of the type described above. U.S. Pat. No. 5,096,156, issued Mar. 17, 1992, may be referred to and is incorporated herein by reference to illustrate motorized damper apparatus employing a transmission incorporating a decoupling mechanism between a damper blade and the motor powering same. Most motorized dampers, however, employ a direct interconnection between the output shaft of the motor and the damper blade. The subject apparatus may be utilized with either damper construction.

DISCLOSURE OF INVENTION

The damper apparatus of the present invention saves space and reduces duct work as compared to conventional damper constructions as described above utilized to deliver air in a controlled manner to a plurality of locations in a building.

The damper apparatus is for receiving a flow of air from a source of flowing air, for dividing the air flow into a plurality of air flow portions directed to a plurality of locations, and for controlling flow of the air flow portions.

The damper apparatus includes a housing comprised of a plurality of interconnecting housing walls defining a housing interior. An air flow inlet is in communication with the housing interior as is an air flow outlet. The air flow inlet and the air flow outlet are spaced from one another.

A first divider is located within the housing interior at a location spaced from the air flow inlet and cooperable with the housing walls to form a plenum communicating with the air flow inlet. The first divider defines a first opening and a second opening, the first and second openings being spaced from one another and leading from the plenum toward the air flow outlet.

A second divider extends from the first divider toward the air flow outlet and is cooperable with the housing walls to define a first passageway between the first opening and the air flow outlet as well as a second passageway between the second opening and the air flow outlet.

A first damper blade is movably mounted relative to the first divider to open or close the first opening to control air flow through the first passageway.

A second damper blade is movably mounted relative to the first divider to open or close the second opening to control air flow through the second opening.

Other features, advantages, and objects of the present invention will become apparent with reference to the following description and accompanying drawings.

BEST MODE FOR CARRYING OUT THE INVENTION

Figure 2:
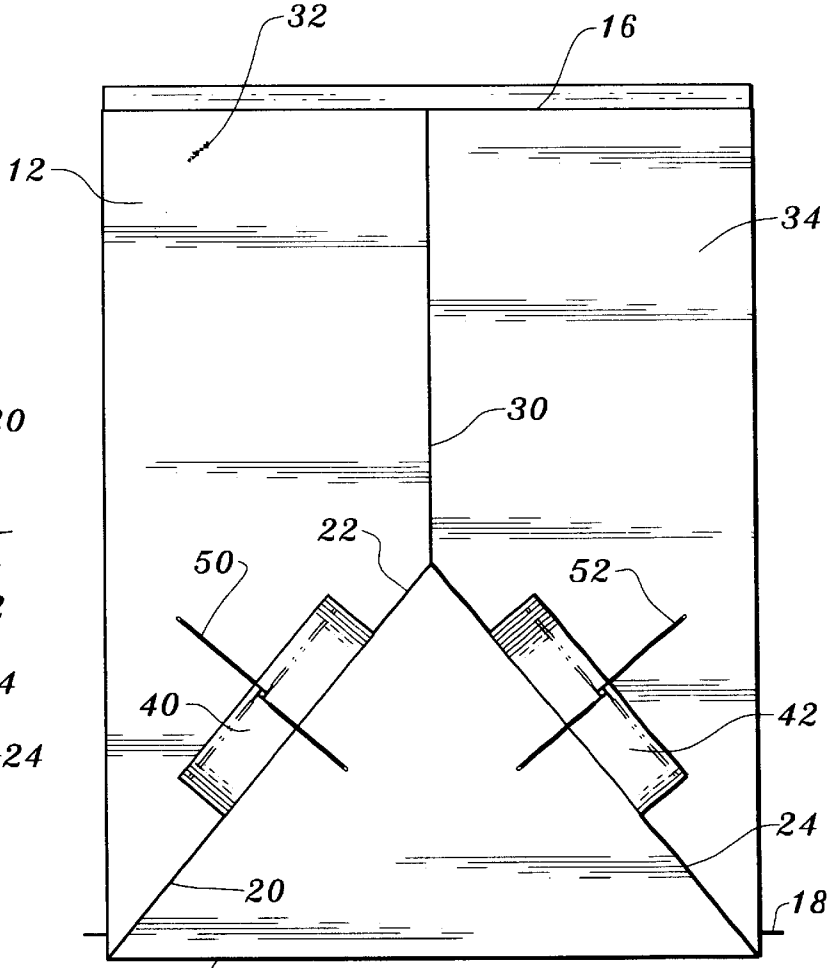
FIG. 2 is a somewhat diagrammatic cross-sectional view taken along the line 2—2 in FIG. 1.
Figure 1:
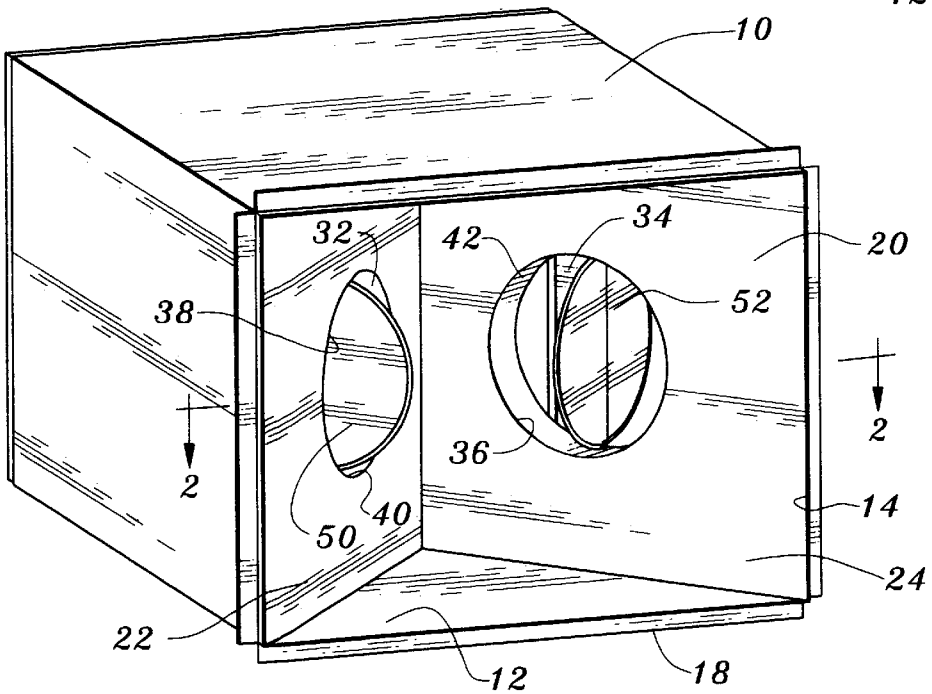
FIG. 1 is a bottom perspective view of damper apparatus constructed in accordance with the teachings of the present invention.
Figure 4:
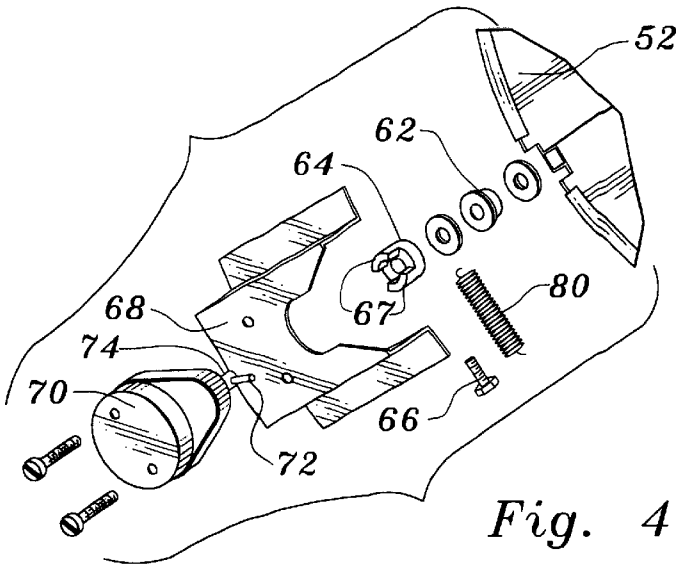
FIG. 4 is an enlarged exploded view of components of the apparatus defined by line 4—4 in FIG. 3.
Figure 3:
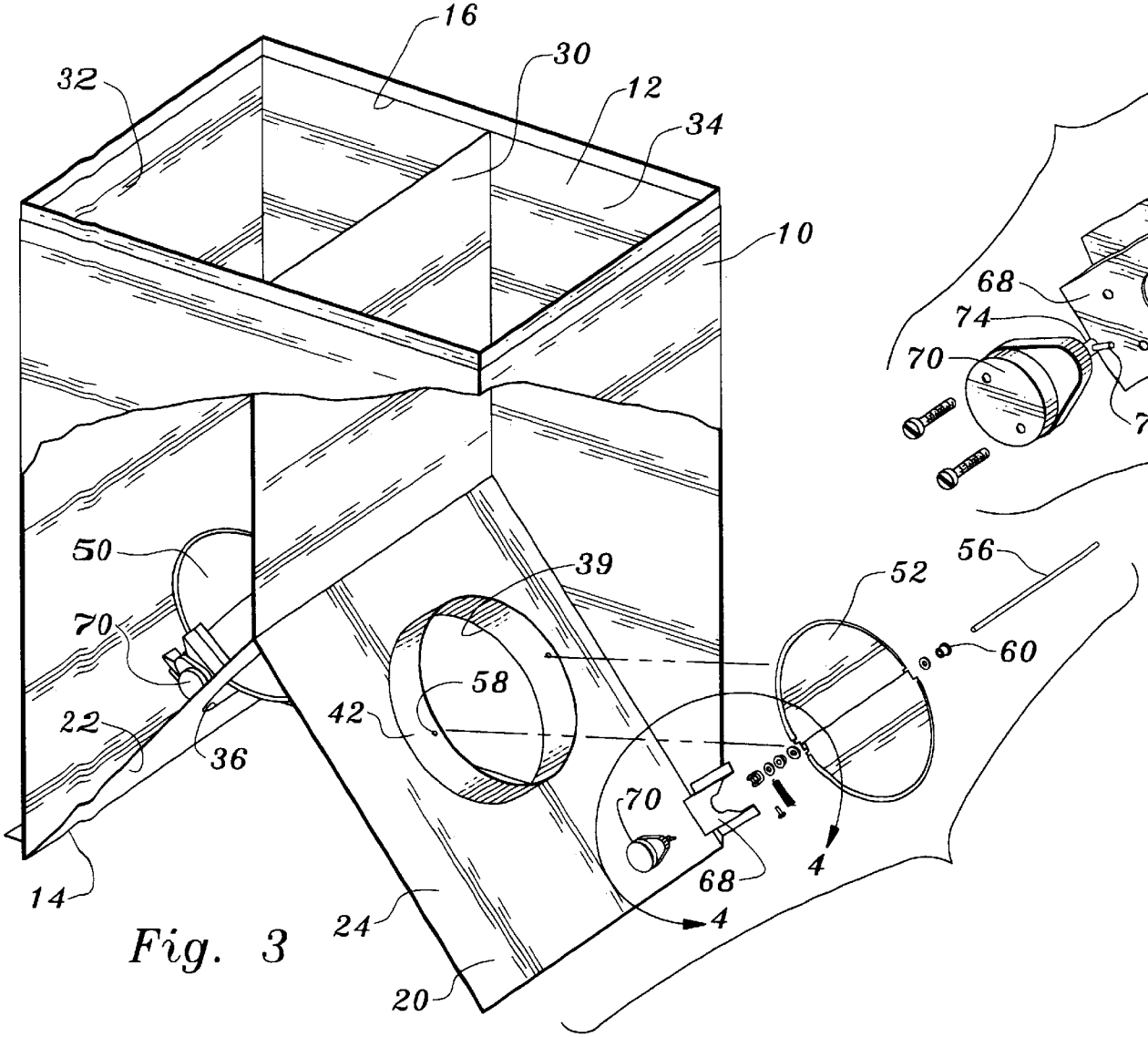
FIG. 3 is an exploded view of the apparatus.

Referring now to FIGS. 1–6 of the drawings, damper apparatus constructed in accordance with the teachings of the present invention includes a housing 10 formed of any suitable material such as metal sheeting or duct board. The housing has a rectangular-shaped cross-section, being formed of a plurality of interconnected rectangular housing walls.

The housing defines a housing interior 12. The housing additionally defines an air flow inlet 14 in communication with the housing interior and an air flow outlet 16 also communicating with the housing interior. The air flow inlet and the air flow outlet are spaced from one another.

A connector flange 18 is located at the air flow inlet end of the housing to connect the damper apparatus to a furnace or other source of flowing air in the same manner that conventional plenum defining housings would be applied thereto.

A divider 20 is located within the housing interior at a location spaced from the air flow inlet. The divider 20 is cooperable with the housing walls to form a plenum communicating with the air flow inlet. In the arrangement illustrated, the divider 20 includes two interconnected, substantially flat divider walls 22, 24 disposed at an angle with respect to one another and converging inwardly from opposed housing walls into the housing interior. The divider walls 22, 24 converge at a straight line of convergence at a location substantially mid-way between the opposed housing walls.

A second divider in the form of a divider plate 30 extends from the line of convergence of divider walls 22, 24 to the air flow outlet 16. Divider plate 30 is cooperable with the walls of the housing to define first passageway 32 and separate second passageway 34, the first and second passageways having a substantially identical cross-sectional configuration. Dividers 20 and 30 may be formed of any suitable material such as metal sheeting or duct board.

Divider walls 22, 24 respectively define circular openings 36, 38. Rim members 40, 42 of circular-shaped configuration project respectively from divider walls 22, 24 at the openings 36, 38, respectively.

Rim member 40 has rotatably mounted therein a circular-shaped damper blade 50. Similarly, a damper blade 52 is rotatably mounted on rim member 42. Each damper blade is operatively associated with mechanism which serves to open or close the opening with which it is associated to control air flow therethrough as well as through passageways 32, 34. In the arrangement illustrated the construction of the damper blades 50, 52 is identical as is the structure utilized to rotate the damper blades. More particularly, the damper blades and related damper blade moving structure illustrated are of the type disclosed in U.S. Pat. No. 5,096,156, issued Mar. 17, 1992, the patent disclosure being incorporated by reference herein.

FIGS. 3–6 illustrate damper blade 52 and the structure operatively associated therewith for moving the damper blade in detail, it being understood that damper blade 50 and its associated damper blade placement or moving structure are of identical construction.

A double-ended support shaft 56 passes through the center of damper blade 52 and is secured thereto. The opposed ends of the support shaft 56 are positioned in opposed openings 58 formed in rim member 42. The support shaft 56 may be held in position for rotatable movement relative to the rim member 42 by any suitable means. For example, the shaft ends may be disposed in bushings 60, 62 to provide rotatable support for the shaft relative to the rim member. Washers may be employed between the bushings and the damper blade.

A coupler element 64 is secured to one end of support shaft 56 by a threaded fastener 66. Coupler element 64 includes two spaced projections or lugs 67 which define notches therebetween. Coupler element 64 extends beyond the outer surface of rim member 42 and is housed within a bracket 68 secured to the rim member 52 by any suitable expedient. An electric motor 70 having a gear box and an output shaft extending from the gear box is fastened to bracket 68 by suitable fasteners such as machine screws.

A coupler element in the form of pin-like projection 72 extends from opposed sides of the motor output shaft, the latter being designated by reference numeral 74. Projections 72 are selectively engagable with the lugs 67 of coupler element 64 during operation of the damper apparatus, as will be described in greater detail below.

Figure 5:
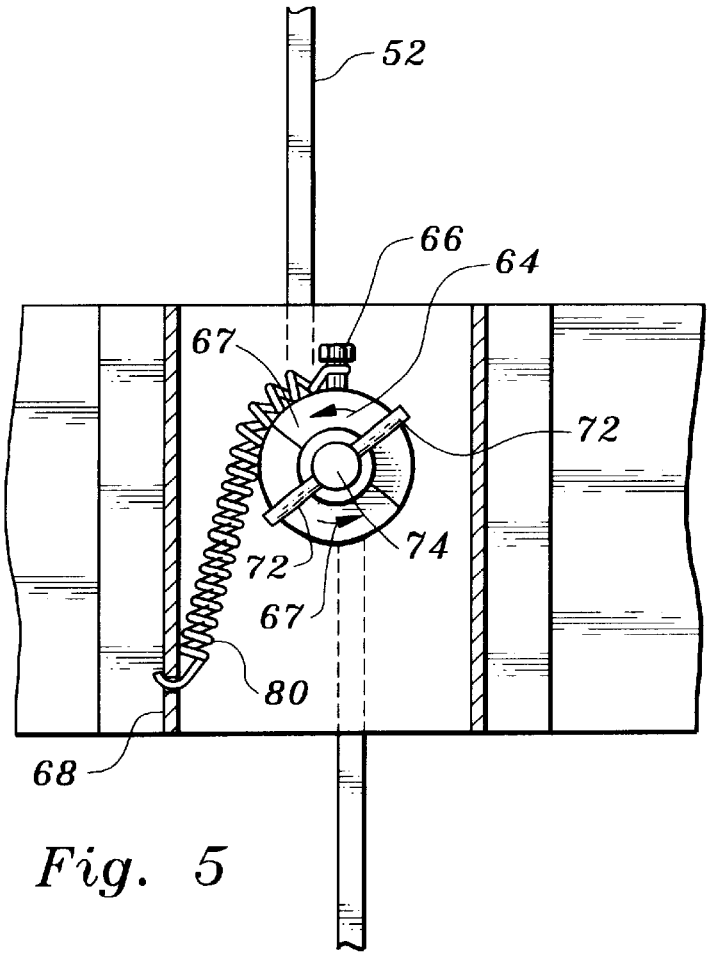
FIG. 5 is an enlarged, fragmentary plan view illustrating the relative positions assumed by selected components of the apparatus during one stage of the operation thereof.
Figure 6:
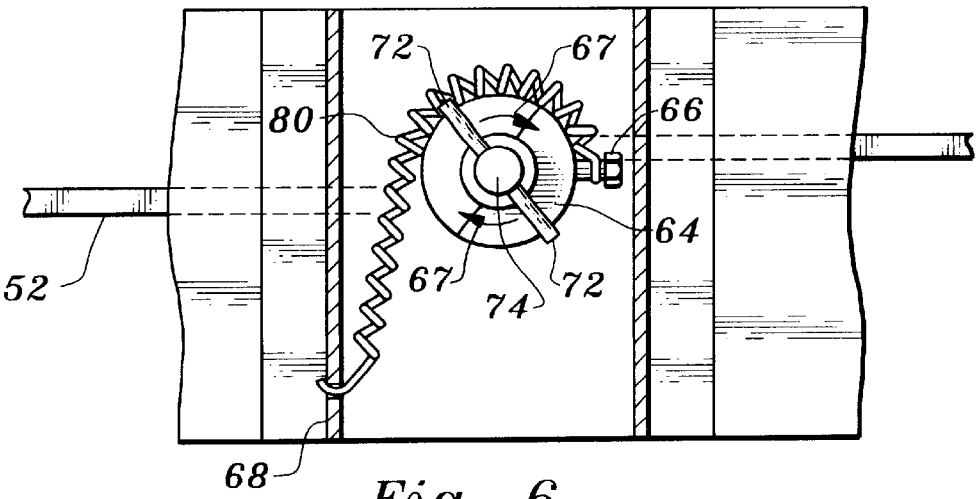
FIG. 6 is a view similar to FIG. 5, but illustrating the relative positions assumed by the components during another phase of the operation of the apparatus.

As may perhaps best be seen with reference to FIGS. 5 and 6, a coil tension spring 80 is attached at one end thereof to threaded fastener 66. The other end of the spring is attached to bracket 68. The spring 80 is always under tension and continuously biases the damper blade 52 to its open or first position wherein the blade is disposed in the center of the rim member 42 interior with the damper blade 52 substantially in alignment with the longitudinal axis of the rim member. This position is illustrated in FIG. 5. A stop of any suitable nature is employed to prevent further movement of the damper blade under the urging of the coil tension spring 80.

From its first or open position, just described, the damper blade 52 is movable to a second or closed position wherein air flow cannot pass through opening 38 or second passageway 34. This second position is depicted in FIG. 6.

As stated above, the spring 80 continuously urges the damper blade 52 to its open position. This is accomplished by virtue of the fact that the coupler element 64 is affixed to support shaft 56 and the shaft is in turn affixed to the damper blade. The damper blade is in the open or first position when the motor 70 is not energized.

When the motor 70 is energized, the pins or projections 72 on the output shaft 74 will rotate and engage the projections or lugs 67 on coupler element 64. This will serve to rotate the support shaft and the damper blade until the damper blade is in its closed position. The damper blade will stay closed until the motor is de-energized.

De-energization of the motor allows spring 80 to rotate the damper blade and return it to its open position or condition. During movement of the damper blade back to its open position, coupler element 64 drives the output shaft 74 in the same rotational direction due to engagement between projections 72 and the projections or lugs 67 on coupler element 64, such projections, of course, also having been in engagement during the entire period of movement of the damper blade from the first to the second position.

It will be appreciated that rotation of the projections or pins 72 and output shaft 74 results in inertial forces being built up in the motor. Such inertia causes the projections 72 to disengage from the projections 67 of coupler element 64 after the damper blade has reached its first or closed position. Output shaft 74 will continue rotation of movement until the inertial energy is expended. The pins or projections 72 have considerable latitude within the notches defined by the lugs or projections 67 of the coupler element 64. This means that the motor, including its gear mechanism, will not be subjected to severe stress.

Figure 7:
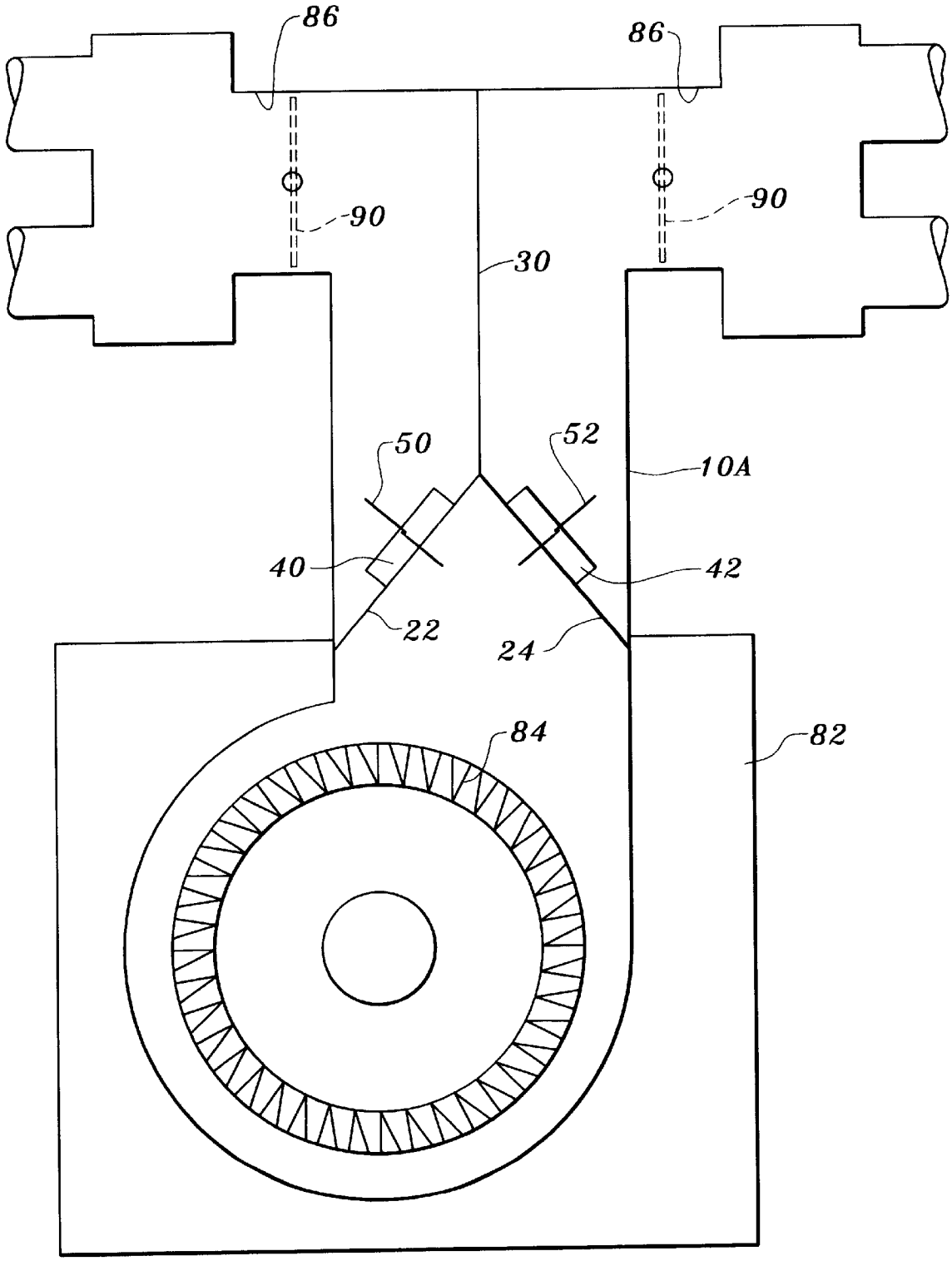
FIG. 7 is a somewhat diagrammatic side view illustrating an alternative embodiment of the invention.

FIG. 7 illustrates an alternative embodiment of the invention wherein housing 10A is connected to the fan outlet of a furnace 82, the fan of the furnace being illustrated in diagrammatic fashion and designated by reference numeral 84.

In this arrangement the air flow outlet defined by housing 10A includes first and second exit openings 86, 88, respectively. Additional damper blades 90 may be located at the exit openings, if desired, to further control air flow to downstream duct work.

We claim:

1. Damper apparatus for receiving a flow of air from a source of flowing air, for dividing said air flow into a plurality of air flow portions directed to a plurality of locations, and for controlling flow of said air flow portions, said damper apparatus comprising, in combination:

a housing comprised of a plurality of interconnected housing walls defining a housing interior, an air flow inlet in communication with said housing interior, and an air flow outlet in communication with said housing interior, said air flow inlet and said air flow outlet being spaced from one another;

a first divider within said housing interior at a location spaced from said air flow inlet and cooperable with said housing walls to form a plenum communicating with said air flow inlet, said first divider defining a first opening and a second opening, said first and second openings being spaced from one another and leading from said plenum toward said air flow outlet;

a second divider extending from said first divider toward said air flow outlet and cooperable with said housing walls to define a first passageway between said first opening and said air flow outlet and a second passageway between said second opening and said air flow outlet;

a first damper blade movably mounted relative to said first divider to open or close said first opening to control air flow through said first passageway; and a second damper blade movably mounted relative to said first divider to open or close said second opening to control air flow through said second opening.

2. The damper apparatus according to claim 1 wherein said first divider includes two interconnected divider walls disposed at an angle with respect to one another and converging inwardly from opposed housing walls into the housing interior.

3. The damper apparatus according to claim 2 wherein said divider walls converge at a line of convergence at a location substantially mid-way between said opposed housing walls.

4. The damper apparatus according to claim 3 wherein said second divider comprises a divider plate extending from said line of convergence to said air flow outlet and cooperable with said opposed housing walls to define first and second passageways of substantially identical cross-sectional configuration.

5. The damper apparatus according to claim 1 wherein said first and second openings have a circular configuration, said damper apparatus additionally including rim members having a circular-shaped configuration attached to and projecting outwardly from said first divider at said first and second openings, said damper blades being rotatably disposed in said rim members.

6. The damper apparatus according to claim 1 additionally comprising damper blade moving means for independently moving said damper blades.

7. The damper apparatus according to claim 6 wherein said damper blade moving means comprises a motor and transmission means operatively associated with each of said damper blades to independently move said damper blades.

8. The damper apparatus according to claim 1 positionable on a furnace having a furnace fan and including means for connecting the housing to the furnace whereby air flow generated by said furnace fan flows into said housing through said air flow inlet.

9. The damper apparatus according to claim 1 wherein the air flow outlet defined by said housing includes separate first and second exit openings, said first passageway leading to said first exit opening and said second passageway leading to said second exit opening.

* * * * *